US009638456B2

(12) United States Patent
Renken et al.

(10) Patent No.: US 9,638,456 B2
(45) Date of Patent: May 2, 2017

(54) MOUNTING SYSTEM FOR A GENERATOR ASSEMBLY

(75) Inventors: David J. Renken, Prior Lake, MN (US); Bernard W. Benson, Lakeville, MN (US); Tom J. Niemi, Eden Prairie, MN (US)

(73) Assignee: THERMO KING CORPORATION, Minneapolis, MN (US)

( * ) Notice: Subject to any disclaimer, the term of this patent is extended or adjusted under 35 U.S.C. 154(b) by 3203 days.

(21) Appl. No.: 11/669,681

(22) Filed: Jan. 31, 2007

(65) Prior Publication Data

US 2008/0179489 A1 Jul. 31, 2008

(51) Int. Cl.

| | |
|---|---|
| ***H02K 5/00*** | (2006.01) |
| ***F25D 23/00*** | (2006.01) |
| ***F25D 19/00*** | (2006.01) |

(52) U.S. Cl.

CPC ..... *F25D 23/006* (2013.01); *F25D 19/003* (2013.01)

(58) Field of Classification Search

USPC ..... 248/637, 674, 675, 201, 220.21, 220.22, 248/221.11, 222.51, 222.52; 123/2; 62/239, 323.1; 322/100, 1; 290/1

See application file for complete search history.

(56) References Cited

U.S. PATENT DOCUMENTS

| | | | | |
|---|---|---|---|---|
| 3,592,019 | A | | 7/1971 | Beaudet |
| 4,109,485 | A | | 8/1978 | Grosskopf |
| 4,348,871 | A | | 9/1982 | Androff |
| 4,394,818 | A | | 7/1983 | Brownfield et al. |
| 4,732,360 | A | | 3/1988 | Bodenheimer |
| 4,834,572 | A | * | 5/1989 | Harrington et al. ..... 403/316 |
| 5,139,359 | A | * | 8/1992 | Rakar et al. ..... 403/24 |
| 5,181,541 | A | * | 1/1993 | Bodenheimer ..... 137/899 |
| 5,222,373 | A | | 6/1993 | Waldschmidt |
| 5,292,096 | A | | 3/1994 | Bodenheimer |
| 5,410,891 | A | | 5/1995 | Ripert |
| 5,498,097 | A | | 3/1996 | Shapess |
| 5,678,512 | A | * | 10/1997 | Colton ..... 123/2 |
| 5,739,675 | A | * | 4/1998 | Green et al. ..... 322/1 |
| 5,744,940 | A | * | 4/1998 | Colton et al. ..... 322/1 |
| 5,762,232 | A | * | 6/1998 | Green et al. ..... 220/564 |
| 5,804,946 | A | | 9/1998 | Gaubatz et al. |

(Continued)

FOREIGN PATENT DOCUMENTS

| | | |
|---|---|---|
| JP | 4327732 | 11/1992 |
| JP | 4340032 | 11/1992 |
| WO | WO 2007035318 A2 * | 3/2007 |

*Primary Examiner* — K Wood

(74) *Attorney, Agent, or Firm* — Hamre, Schumann, Mueller & Larson, P.C.

(57) ABSTRACT

A generator assembly for mounting to a container. The generator assembly includes a container frame having a top casting and a receiver bracket. The generator assembly includes a frame, a generator coupled to the frame, a clamp mounting system including a first clamp coupled to the frame and configured to be coupled to the top casting, and a pin mounting system including a first bracket coupled to the frame and configured to be coupled to the receiver bracket. The generator assembly is such that one of the first clamp and the first bracket is repositionable on the frame to avoid interference with the container when the other of the first clamp and the first bracket is coupled to the corresponding one of the top casting and the receiver bracket.

3 Claims, 7 Drawing Sheets

(56) References Cited

U.S. PATENT DOCUMENTS

| | | | | |
|---|---|---|---|---|
| 5,916,253 | A | 6/1999 | Amr et al. | |
| 5,960,637 | A | 10/1999 | Stevens et al. | |
| 6,145,334 | A | 11/2000 | Mochizuki et al. | |
| 6,354,555 | B1 | 3/2002 | Nishizuka et al. | |
| 7,131,804 | B2 * | 11/2006 | Sawchuk | 410/100 |
| 2006/0059932 | A1 | 3/2006 | Czechowicz et al. | |
| 2008/0231239 | A1 * | 9/2008 | Mertell et al. | 322/1 |

* cited by examiner

MOUNTING SYSTEM FOR A GENERATOR ASSEMBLY

FIELD OF THE INVENTION

The present invention relates to generator assemblies for mounting to containers and a method of mounting the same.

BACKGROUND

Storage containers are typically fabricated with a frame including corner castings primarily useful for lifting the container. The corner castings can typically be used to mount generator sets built with a clamp mounting system having specially mounted clamps. Other types of storage containers can have receiver brackets welded to the frame for use with generator sets that have a pin mounting system.

Conventional generator assemblies include only one of the two mounting systems. They do not have both the clamp mounting and pin mounting systems on the same generator assembly because the mounting methods are not generally conducive to each other. For instance, when utilizing the clamp mounting system, the pin mounting system interferes with the container, and vice versa, when utilizing the pin mounting system, the clamp mounting system interferes with the container.

SUMMARY

In one embodiment, the invention provides a generator assembly for mounting to a container including a container frame having a top casting and a receiver bracket. The generator assembly includes a frame and a generator coupled to the frame. The generator assembly further includes a clamp mounting system including a first clamp coupled to the frame and configured to be coupled to the top casting. The generator assembly further includes a pin mounting system including a first bracket coupled to the frame and configured to be coupled to the receiver bracket. Either the first clamp or the first bracket is repositionable on the frame to avoid interference with the container when the other is coupled to the corresponding top casting or the receiver bracket.

In another embodiment, the invention provides a method of mounting a generator assembly to a container. The method includes providing a container including a container frame having a top casting and a receiver bracket and providing a generator assembly having a frame. The method further includes coupling a first clamp of a clamp mounting system to the top casting, and coupling a first bracket of a pin mounting system to the receiver bracket. The method further includes repositioning either the first clamp or the first bracket to avoid interference with the container when the other is coupled to the corresponding top casting or receiver bracket.

In another embodiment, the invention provides a generator assembly for mounting to a container including a container frame having first and second top castings and first and second receiver brackets. The generator assembly includes a frame. The generator assembly further includes a clamp mounting system including a first clamp coupled to the frame and configured to be coupled to the first top casting and a second clamp coupled to the frame and configured to be coupled to the second top casting. The generator assembly also includes a pin mounting system including a first bracket coupled to the frame and configured to be coupled to the first receiver bracket and a second bracket coupled to the frame and configured to be coupled to the second receiver bracket. Either the pair of the first and second clamps or the first and second brackets are repositionable on the frame to avoid interference with the container when the other pair is coupled to the corresponding pair of the first and second top castings or the first and second receiver brackets.

Other features and advantages of the invention will become apparent to those skilled in the art upon review of the following detailed description, claims, and drawings.

BRIEF DESCRIPTION OF THE DRAWINGS

The present invention is further described with reference to the accompanying drawings, which show at least one construction of the present invention. However, it should be noted that the invention is explained and illustrated by way of example only. The various elements and combinations of elements described below and illustrated in the drawings can be arranged and organized differently to result in constructions which are still within the spirit and scope of the present invention. Also, it is understood that the phraseology and terminology used herein is for the purpose of description and should not be regarded as limiting.

In the drawings, wherein like reference numerals indicate like parts.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
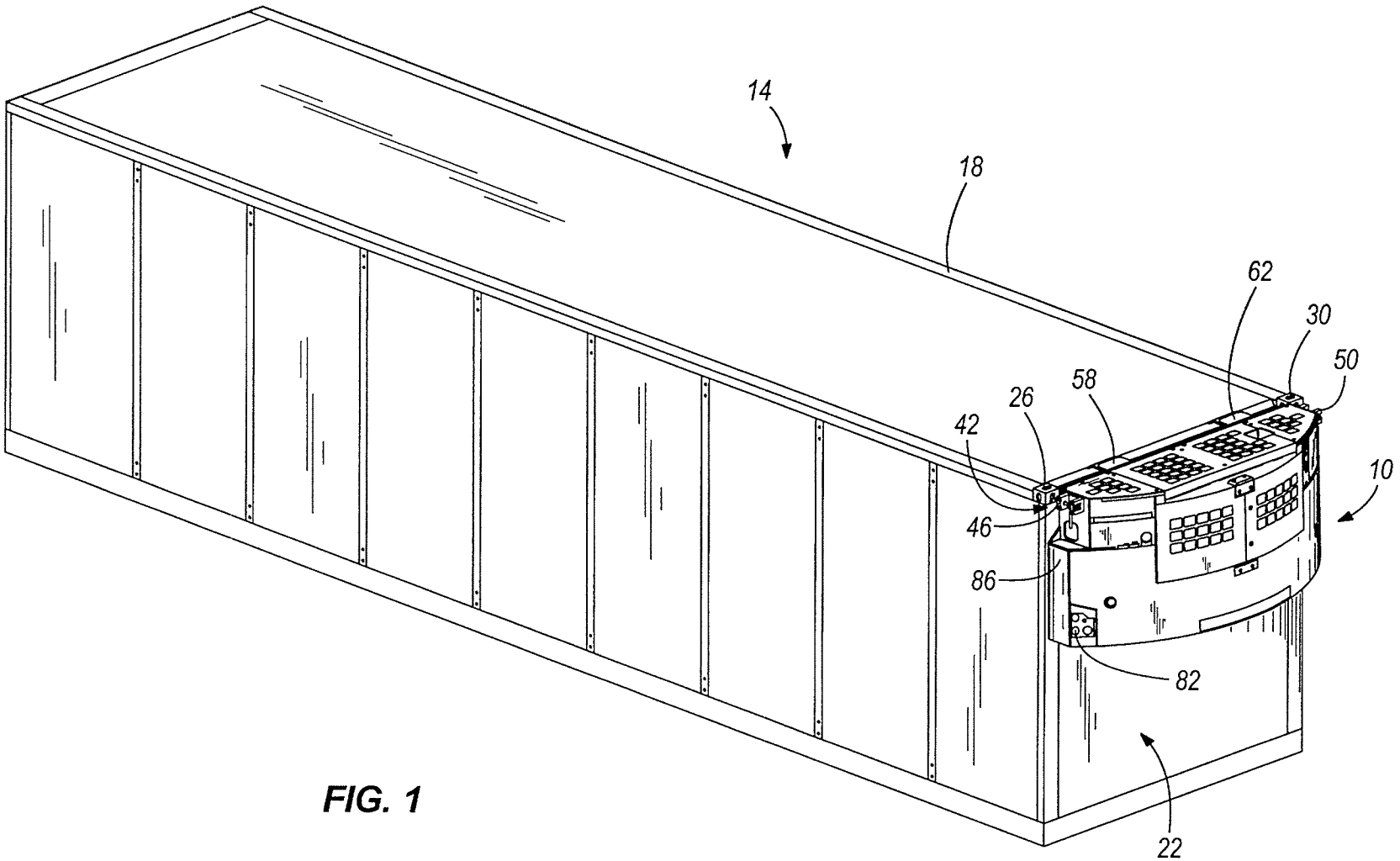
FIG. 1 is a perspective view of a generator assembly mounted to a container embodying aspects of the present invention.
Figure 2:
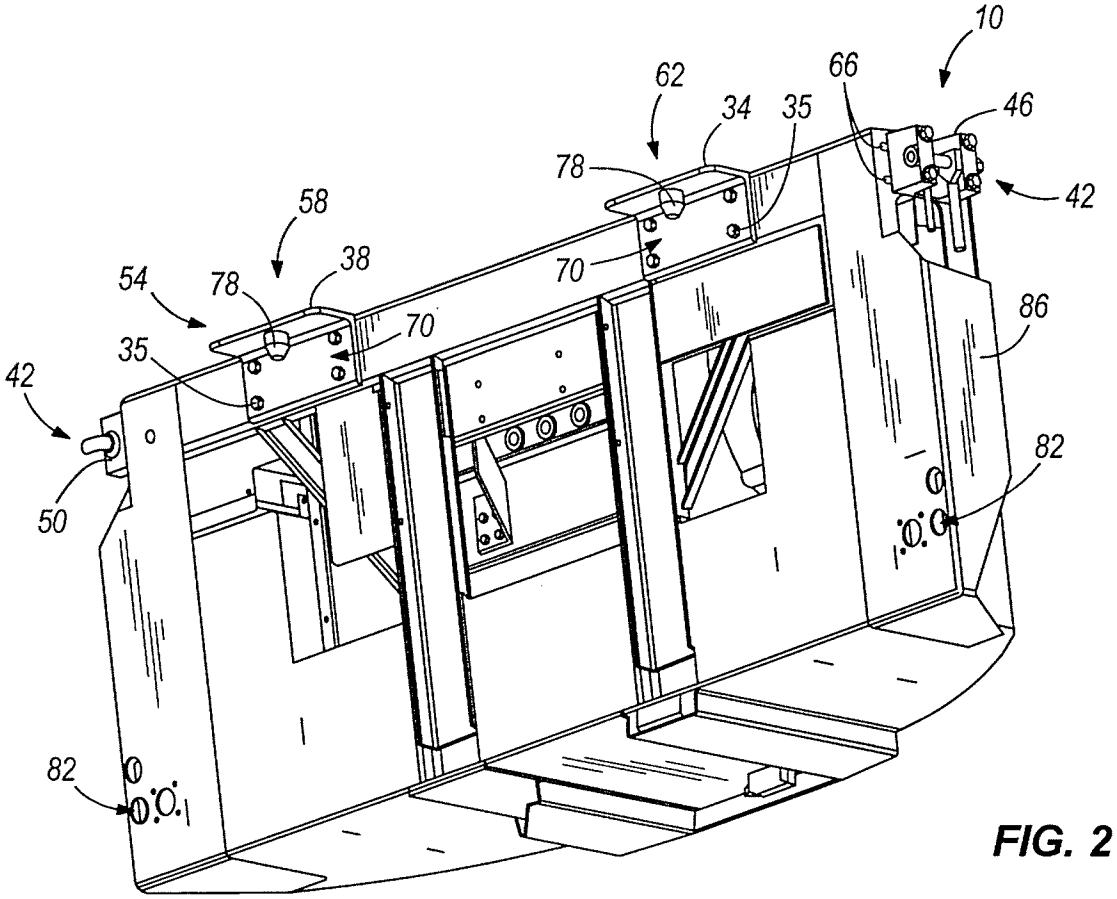
FIG. 2 is a rear perspective view of the generator assembly of the present invention.
Figure 3:
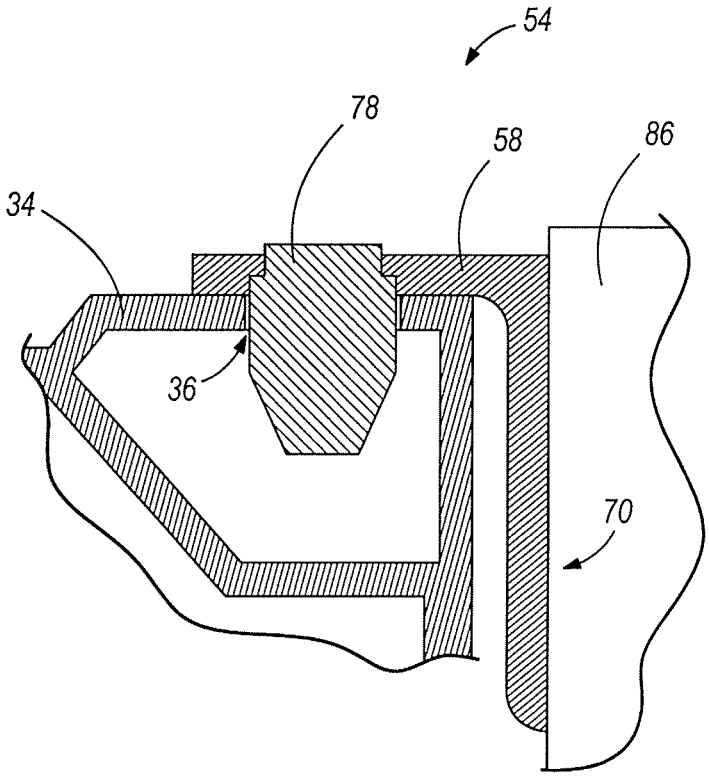
FIG. 3 is a cross-sectional view of the pin mounting system of the present invention.
Figure 4:
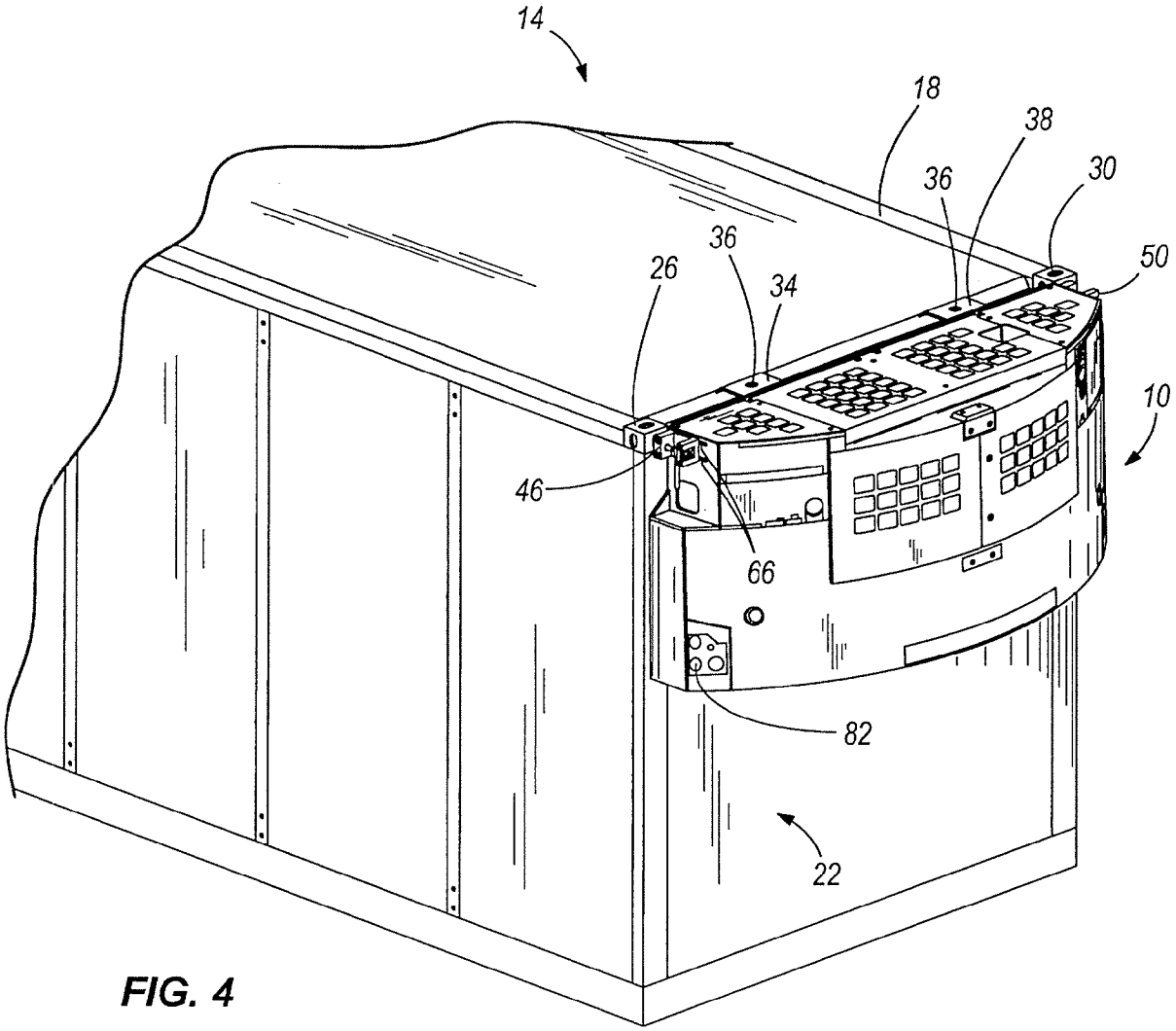
FIG. 4 is a front perspective view of a generator assembly mounted to a container embodying aspects of the present invention.

FIGS. 1-8 illustrate a generator assembly 10 mounted to a container 14 in accordance with the present invention. The generator assembly 10 provides a source of electric power for a temperature control unit (not shown). As shown in FIGS. 1 and 4, the container 14 includes a container frame 18, a front frame portion 22, a first top casting 26, a second top casting 30, a first receiver bracket 34, a second receiver bracket 38.

The container frame 18 has a front frame portion 22. The front frame portion 22 has a first top casting 26 and a second top casting 30 located at a top end of the container frame 18. The first top casting 26 and the second top casting 30 are welded to the front frame portion 22. The first top casting 26 and the second top casting 30 are typically used to mount generator sets built with a clamp mounting system having specially mounted clamps. The first top casting 26 and the second top casting 30 generally have apertures 32 (FIG. 5) to receive a first clamp 46 and a second clamp 50. The front frame portion 22 further includes a first receiver bracket 34 and a second receiver bracket 38. The first receiver bracket 34 and the second receiver bracket 38 are welded to the front frame portion 22 for use with generator sets that have a pin mounting system 54. The first receiver bracket 34 and the second receiver bracket 38 generally have apertures 36 to receive pins 78 of a first bracket 58 and a second bracket 62.

The container 18 illustrated includes the first top casting 26, the second top casting 30, the first receiver bracket 34, and the second receiver bracket 38. In some embodiments, the container 18 can have any combination of first top casting 26, second top casting 30, first receiver bracket 34 and second receiver bracket 38. Generally, all containers have top castings and some may additionally contain a pair of receiver brackets.

As shown in FIG. 2, the generator assembly 10 includes a generator frame 86 with tracks 66. The track 66 is configured to receive a portion of a clamp mounting system 42. A portion of the clamp mounting system 42 is configured to be slidably received by the track 66. The clamp mounting system 42 includes a first clamp 46 positioned on the track 66 to couple the first clamp 46 to the generator frame 86. The first clamp 46 is positioned and configured to be coupled to the first top casting 26. The clamp mounting system 42 further includes a second clamp 50 positioned on the track 66 to couple the second clamp 50 to the generator frame 86. The second clamp 50 is positioned and configured to be coupled to the second top casting 30.

The generator assembly 10 further includes a pin mounting system 54 having a first bracket 58 coupled to the generator frame 86 with an attachment device 35 and configured to be coupled to the first receiver bracket 34. In some embodiments, the attachment device 35 can be a series of threaded bolts. The pin mounting system 54 further includes a second bracket 62 coupled to the generator frame 86 with an attachment device 35 and configured to be coupled to the second receiver bracket 38.

As shown in FIG. 3, the pin 78 is extended through aperture 36 to couple the bracket 58 to the receiver bracket 34. The pin 78 acts to retain the generator assembly 10 on the container frame 18. A similar mounting system is used to couple the bracket 62 to the receiver bracket 34.

With reference to FIGS. 1-8, the operation of both the clamp mounting system 42 and the pin mounting system 54 are illustrated. More specifically, FIGS. 1-3 illustrate the operation of the pin mounting system 54. When the pin mounting system 54 is utilized to attach the generator assembly 10 to the container frame 18, the clamp mounting system 42 is in the retracted position. To couple the generator assembly 10 to the container frame 18, pins 78 are placed in the first bracket 58 and the second bracket 62 and received by the apertures 36 in the receiver brackets 34, 38. To uncouple the generator assembly 10 from the container frame 18 when using the pin mounting system 54, the pins 78 are removed from the apertures 36. The first bracket 58 and second bracket 62 may be repositioned to be stored on the generator assembly 10 in one of a plurality of a storage locations 74 (illustrated in FIGS. 7 and 8). The mounting locations 70 and the storage locations 74 have similar mounting features, such that the brackets 58, 62 are coupled to the generator assembly 10 with an attachment device 35.

Figure 5:
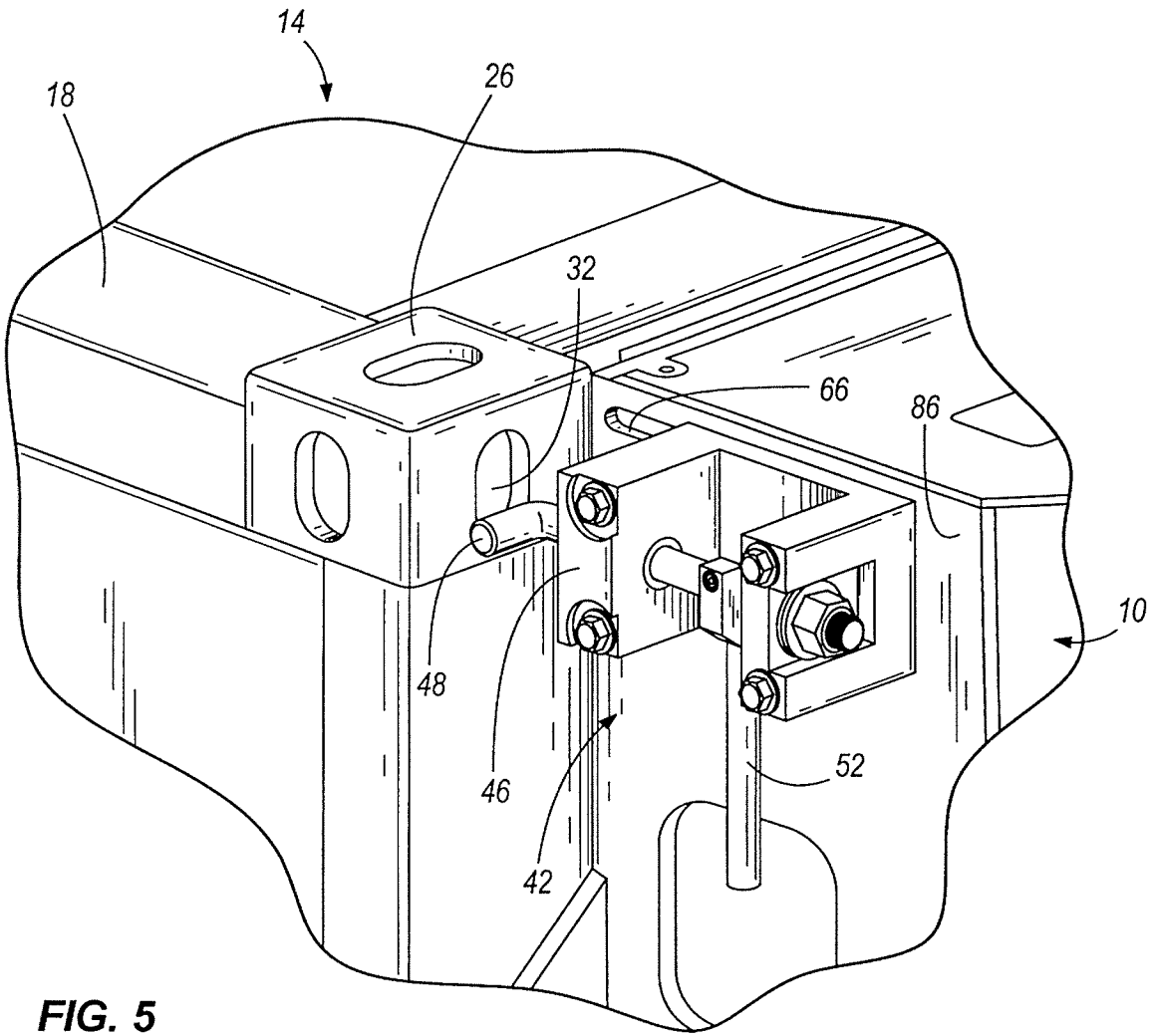
FIG. 5 is a detailed view of the clamp mounting system of the present invention in an extended position.
Figure 6:
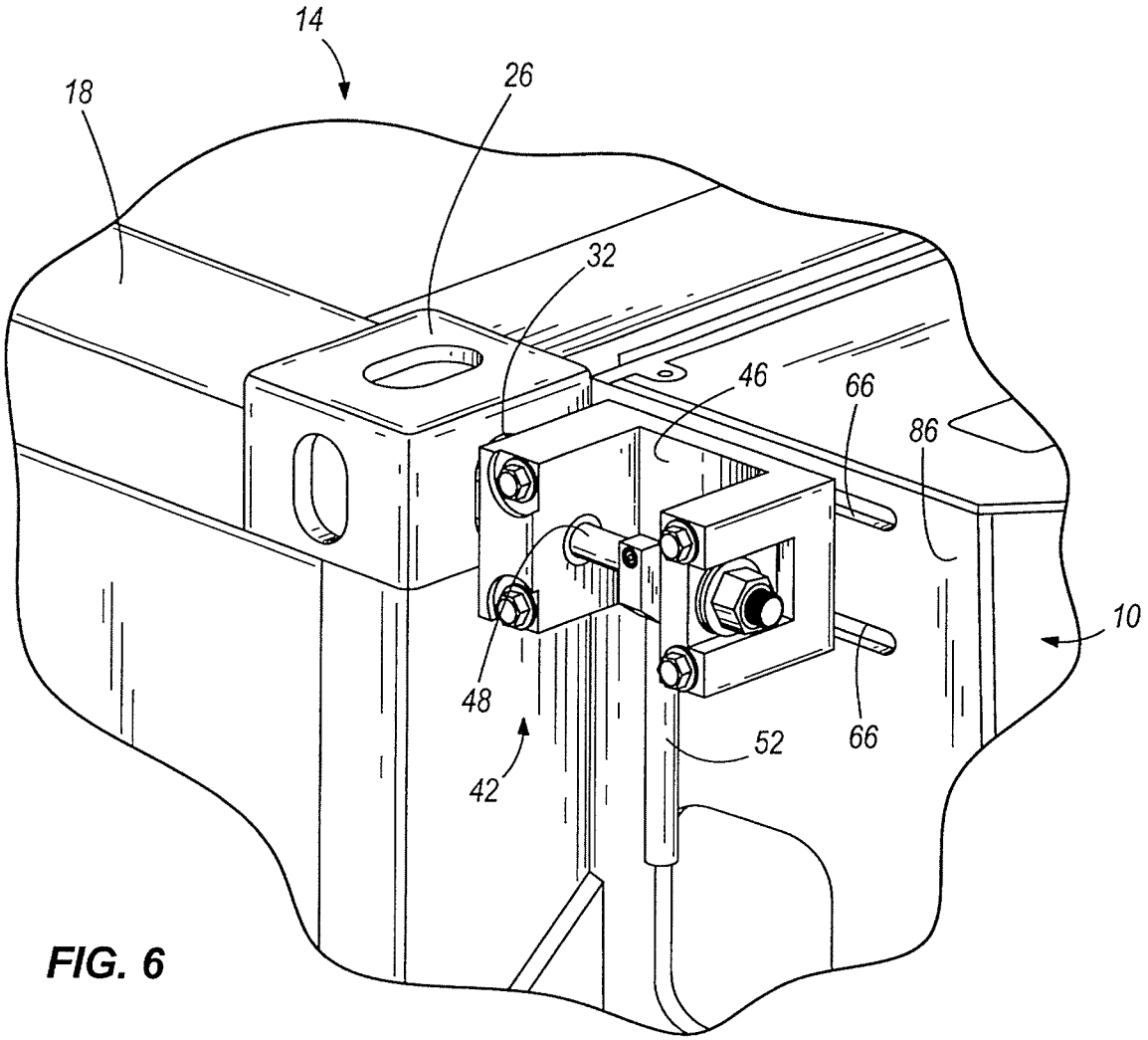
FIG. 6 is a detailed view of the clamp mounting system of the present invention in the retracted position.
Figure 7:
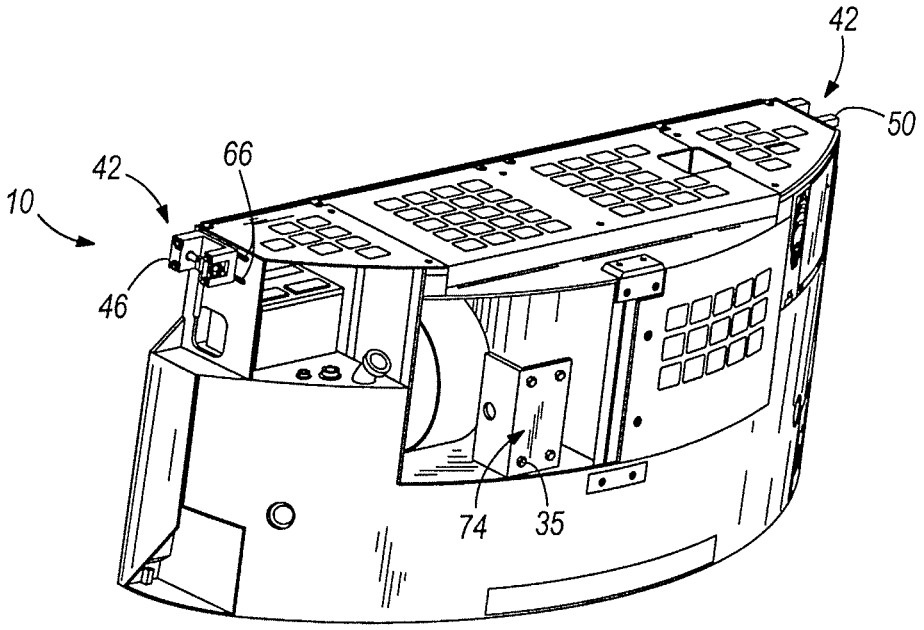
FIG. 7 is a front perspective view of the generator assembly of the present invention.
Figure 8:
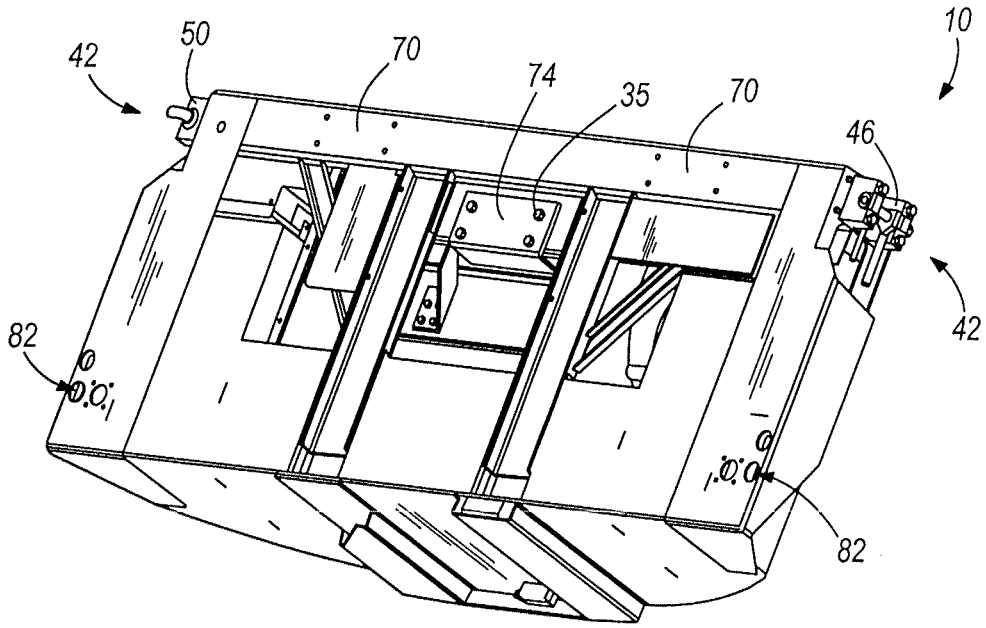
FIG. 8 is a rear perspective view of a generator assembly of the present invention.

With reference to FIGS. 4-8, the operation of the clamp mounting system 42 is illustrated. The first clamp 46 is coupled to the generator frame 86 for movement between a retracted position and an extended position. FIG. 5 illustrates the clamp mount 46 in a retracted position. FIG. 6 illustrates the clamp mount 46 in an extended position and coupled to the top casting 26. To enable movement of the clamp mounts 46, 50 from an extended position to a retracted position, the generator frame 86 includes at least one track 66. The track 66 is configured to slidingly receive a portion of the clamp mounts 46, 50.

To couple the generator assembly 10 to the container frame 18 using the clamp mounting system 42, the clamp mounts 46, 50 are positioned in an extended position (illustrated in FIGS. 4 and 6). In the extended position, the clamp mounts 46, 50 are configured to couple the generator assembly 10 to the top castings 26, 30. The clamp mounts 46, 50 couple the generator assembly 10 to the top castings 26, 30 by positioning the clamp bolt 48 in the top casting 26, 30 by manipulation of the clamp pole 52. When the clamp mounting system 42 is in the extended position, the first clamp 46 and second clamp 50 are coupled to the container frame 18 at the first top casting 26 and the second top casting 30, respectively. When the clamp mounting system 42 is being utilized, the brackets 58, 62 are stored at the storage locations 74.

To uncouple the generator assembly 10 from the container frame 18 when using the clamp mounting system 42, the clamp pole 52 is manipulated to actuate the clamp bolt 48 to allow the clamp bolt 48 to be removable from the top casting 26. Removing the clamp bolt 48 from the top casting 26 enables the clamp mount 46 to be slidingly positioned along the track 66 to the retracted position such that the brackets 58, 62 can then be positioned in the mounting locations 70 to enable pin mounting of the generator assembly 10 to a new container utilizing a pin mounting system.

In some embodiments, in addition to the clamp mounting system 42 and the pin mounting system 54, the generator assembly 10 has bolt mounts 82 (FIG. 8) to further couple the generator assembly 10 to the container frame 18. The bolt mounts 82 can couple the bottom of the generator assembly 10 to the container frame 18 regardless of the whether the clamp mounting system 42 or the pin mounting system 54 is used.

Other embodiments of the present invention may utilize combinations of the above embodiments. The embodiments described above and illustrated in the figures are presented by way of example only and are not intended as a limitation upon concepts and principles of the present invention. As such, it will be appreciate by one having ordinary skill in the art that various changes in the elements and their configuration and arrangement are possible without departing from the spirit and scope of the present invention as set forth in the claims.

What is claimed is:

1. A generator assembly for mounting to a container including a container frame having at least one of a top casting and a receiver bracket, the generator assembly comprising:

a generator frame;

a generator coupled to the generator frame;

a clamp mounting system including a first clamp coupled to the generator frame and configured to be coupled to the top casting; and a pin mounting system including a first bracket and a second bracket repositionably coupled to the generator frame for movement between a mounting position and a storage position and configured to be coupled to the receiver bracket when in the mounting position and configured to avoid interference with the container when in the storage position, wherein the first clamp is repositionable on the generator frame to avoid interference with the container when the first bracket is coupled to the receiver bracket.

2. The generator assembly of claim 1, wherein the clamp mounting system includes a second clamp coupled to the generator frame and configured to be coupled to a second top casting of the container frame.

3. The generator assembly of claim 1, wherein the first clamp is repositionably coupled to the generator frame for movement between a retracted position and an extended position, the first clamp configured for coupling to the top casting when in the extended position and configured to avoid interference with the container when in the retracted position, wherein the retracted position is closer to the front of the generator frame than the extended position.

* * * * *